US005859917A

United States Patent [19]

Silber et al.

[11] Patent Number: 5,859,917

[45] Date of Patent: Jan. 12, 1999

[54] FLUSH-MOUNT SWIVEL TWEETER SYSTEM FOR VEHICULAR AUDIO

[75] Inventors: Michael W. Silber, Lancaster; Andrew I. Wehmeyer, Woodland Hills; Aaron L. Butters, Thousand Oaks, all of Calif.

[73] Assignee: Infinity Systems Inc., Chatsworth, Calif.

[21] Appl. No.: 905,605

[22] Filed: Aug. 4, 1997

[51] Int. Cl.[6] ..... H04R 25/00

[52] U.S. Cl. ..... 381/389; 181/150; 381/386

[58] Field of Search ..... 381/389, 302; 181/150, 199

[56] References Cited

U.S. PATENT DOCUMENTS 4,292,679 9/1981 Kondo et al. ..... 181/171
4,550,796 11/1985 Tomita ..... 381/389
4,917,212 4/1990 Iwaya ..... 381/389

*Primary Examiner*—Sinh Tran
*Attorney, Agent, or Firm*—J. E. McTaggart

[57] ABSTRACT

A flush-mount swivel tweeter system for vehicular audio utilizes a tweeter unit enclosed in hemispherical shell housing, which fits in a swivel manner into a mating cavity in a mounting bushing configured externally with a threaded sleeve having a thin peripheral decorative front flange. The resulting swivel tweeter assembly can be flush-mounted through a round opening provided in the host panel. The flange is secured against the panel by a large mounting nut threaded onto the mounting bushing from the rear. A circular aiming range is available by a combination of swivelling the tweeter unit off-axis and rotating the entire assembly in the panel opening. Once aimed, the swivel tweeter is clamped in place by a nut and washer at the rear, and the mounting bushing is secured in place by tightening the large mounting nut against the rear of the panel.

9 Claims, 5 Drawing Sheets

FLUSH-MOUNT SWIVEL TWEETER SYSTEM FOR VEHICULAR AUDIO

FIELD OF THE INVENTION

The present invention relates to the field of vehicular audio, and more particularly it relates to a mounting system for a tweeter (high frequency loudspeaker) that is substantially flush with a mounting surface and that also allows swivel adjustment of the tweeter for acoustic directional purposes.

BACKGROUND OF THE INVENTION

Loudspeakers in vehicles pose special problems: typically the main loudspeakers are almost always, of necessity, installed in an offset location relative to the ears of the driver or passenger, consequently the high frequency response as perceived by the listener tends to be degraded unless specially located tweeters are deployed.

Due to the highly directional properties of high audio frequencies, and less-than-ideal mounting locations available for tweeters in vehicles, it is highly desireable to swivel-mount the two stereo tweeters so that they can be oriented and aimed to favor the listener's location.

In particular vehicles there may be flat panels suitably located for mounting tweeters so that a separate housing is not required; in some instances the flat panel location is such that no protrusion is allowable, thus flush mounting of the tweeter assembly is desireable.

DISCUSSION OF RELATED KNOWN ART

U.S. design Pat. No. 319,243 to Yamakawa exemplifies a small loudspeaker mounted in a fixed manner within a shell housing as opposed to panel-mounting.

U.S. Pat. No. 5,148,490 to Draffen discloses stereo tweeters, contained in a rotatable manner within a small shell housing, mounted in frontal locations at opposite side edge region of the front windshield.

U.S. Pat. Nos. 5,133,428 to Person and 4,277,653 to Pawelzick exemplify loudspeaker panel mount system that protrude substantially forward from the panel; '428 is direction-adjustable while '653 is fixed.

U.S. Pat. Nos. 4,365,114 to Soma, 4,292,679 to Kondo et al, and 4,630,303 to Tanno all disclose mechanisms for mounting tweeters in an adjustable manner.

None of the foregoing patents or other known art teach or disclose panel-mounting a tweeter in a manner that is substantially flush with the panel and that permits swivel directional adjustment of the tweeter.

OBJECTS OF THE INVENTION

It is a primary object of the present invention to provide a set of mounting hardware forming a tweeter shell assembly that provides substantially flush panel mounting while enabling the tweeter to swivel for directional performance purposes.

It is a further object that the tweeter shell be mountable in a circular opening in the panel.

SUMMARY OF THE INVENTION

The abovementioned objects have been accomplished by the present invention wherein a tweeter assembly, including a shell housing, fits in a swivel manner into a threaded mounting bushing with a thin front flange, configured and arranged to mount through a round opening in the panel, where the thusly formed tweeter assembly may be rotated as desired and secured in place by a large nut threaded onto the mounting bushing from the rear.

The inside of the mounting bushing is formed in part as a spherical cavity conforming to the rear portion of a hemispheric shell housing that contains the tweeter. Thus the tweeter assembly is enabled to swivel in one axis in the mounting bushing for aiming the tweeter assembly off-axis within a working range, after which it can be locked in place in the mounting bushing by a nut and lockwasher on a bolt extending rearwardly from the shell housing. Rotation of the bushing in the circular panel opening, in combination with the swivel adjustment range, allows the tweeter to be aimed anywhere in a circular field within the range.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
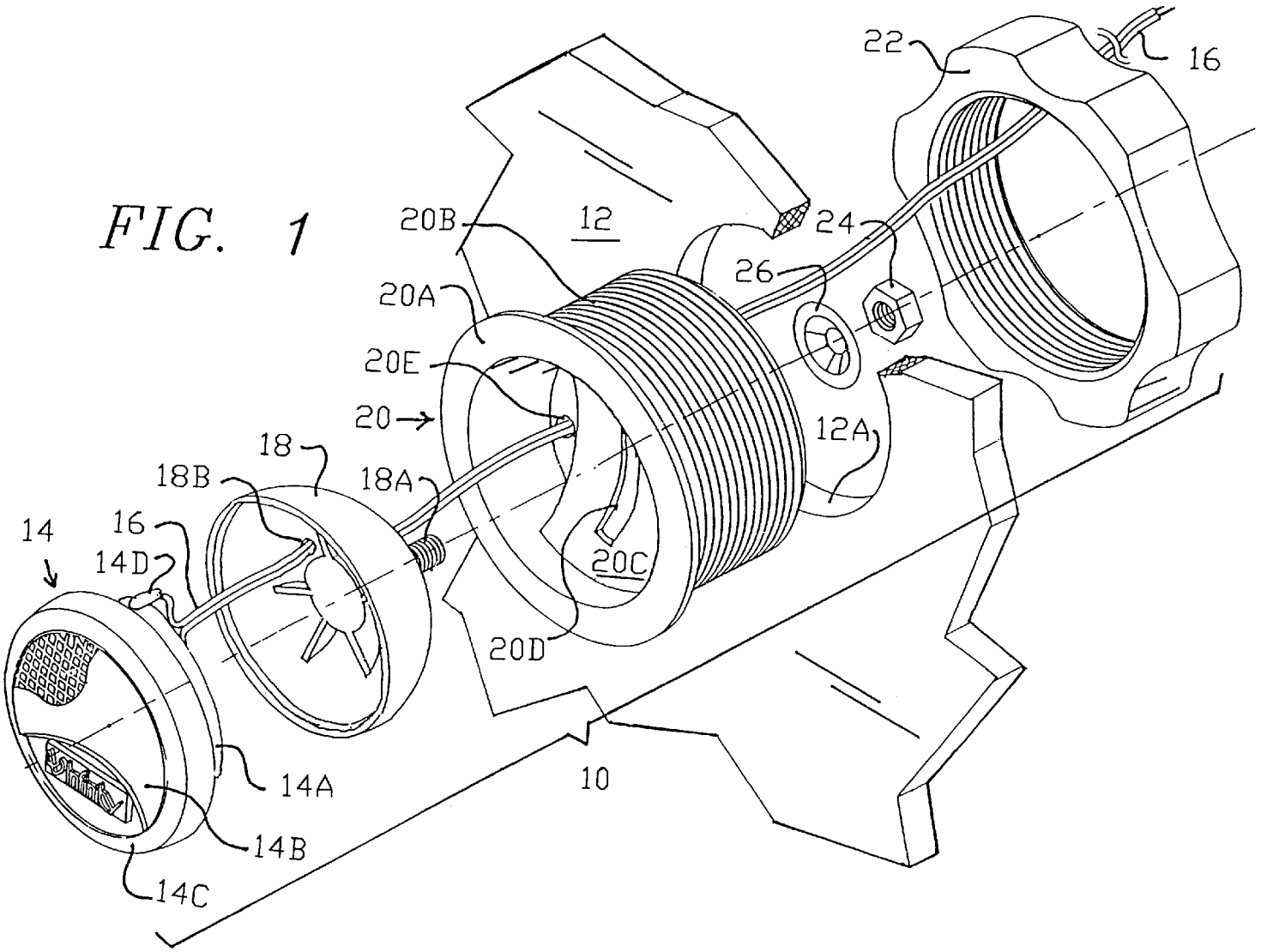
FIG. 1 is a three-dimensional partially-exploded view showing the components of the present invention in relation to a mounting panel shown as a cutaway portion.

FIG. 1 shows a three-dimensional exploded view of the component parts of a flush-mount swivel tweeter speaker assembly 10 in accordance with the present invention in a preferred embodiment, shown in relation to a region of panel 12 which is made to have a circular opening 12A into which the assembly 10 is to be flush-mounted.

A tweeter unit 14 includes a high frequency electro-acoustic transducer 14A with a protective front grill 14B surrounded by a circular frame 14C. A length of hookup wire 16, formed in a pair, is connected to a pair of terminals 14D, of which only one is visible in this view.

A hemispherically-shaped shell housing 18 is made to attach to circular frame 14C of the tweeter unit 14 in a detented manner; frame 14C is shaped externally so as to conform to the hemispherical shape of shell housing 18 and extend this shape to substantially exceed 50% of a sphere, in order to facilitate swivel rotation. A machine bolt 18A is anchored in shell housing 18, typically by integrally molding it in place, in a coaxial position so that its shaft portion extends to the rear as shown. The hookup wire 16 passes through shell housing 18 via a small circular opening 18B as shown.

A mounting bushing 20 is configured with a thin annular peripheral front flange 20A and a cylindrical threaded main exterior sleeve 20B that fits through opening 12A, where it is to be secured in place by a mounting nut 22. Internally, bushing 20 is configured with a rear bulkhead defining a forwardly-open cavity region having a hemispheric bearing surface 20C that is shaped to interface with the hemispheric external surface of shell housing 18. Bearing surface 20C is configured with a swivel guide slot 20D which accepts bolt 18A for securing shell housing 18 in place against bearing surface 20C with a retaining nut 24 and a spring fender washer 26 installed from the rear. The swivel guide slot 20D allows tweeter unit 14 to swivel in one axis with respect to bushing 20 to an off-axis limit in either direction. The hookup wire 16 passes through bushing 20 via a small circular opening 20E as shown.

Figure 2:
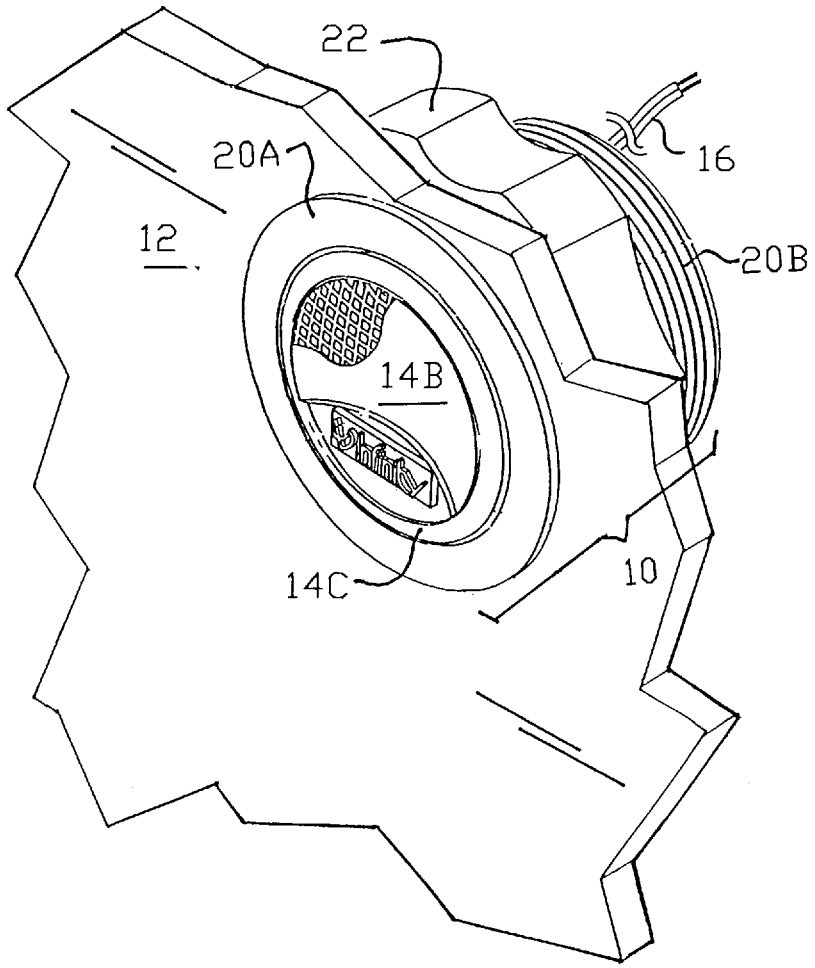
FIG. 2 is a three-dimensional view of a tweeter assembly formed from the components of FIG. 1, flush-mounted to the panel in a finished installation.

FIG. 2 is a three-dimensional view of swivel tweeter assembly 10 with the component parts of FIG.1 assembled and flush-mounted in panel 12. Swivel tweeter assembly 10 is enclosed in bushing 20 which is mounted flush with panel 12 so that the only components normally visible from the front are flange 20A of bushing 20, a portion of circular frame 14C, and grill 14B with the perferation pattern shown in part. This view, with panel 12 cutaway as shown, reveals a portion of mounting nut 22, threaded sleeve 20B of bushing 20, and hookup wire 16 at the rear of panel 12.

Figure 3:
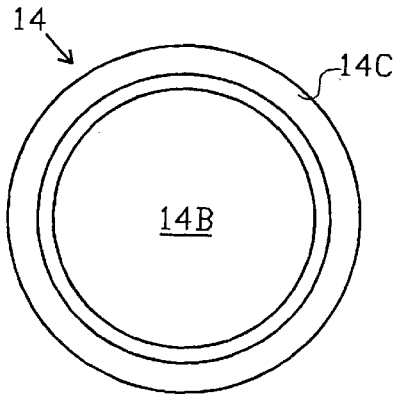
FIG. 3 is a front elevation of tweeter assembly shown in FIG. 1.

FIG. 3 is a front elevation of tweeter unit 14 showing the front grill 14B and a portion of circular frame 14C.

Figure 3A:
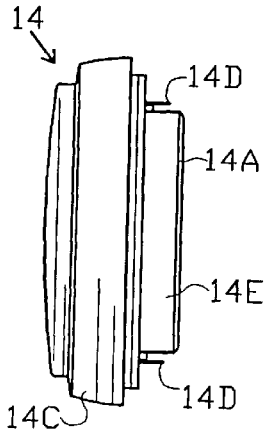
FIG. 3A is a side view of the tweeter assembly of FIG. 3.

FIG. 3A is a side view of tweeter unit 14 showing circular frame 14C in profile, tweeter 14A held in place in a support sleeve 14E attached to circular frame 14C, and the pair of electrical terminals 14D.

Figure 3B:
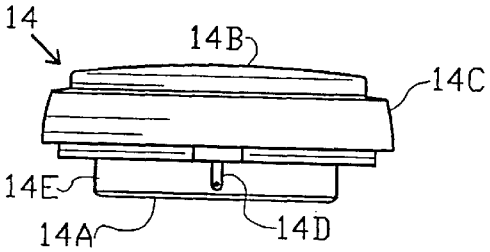
FIG. 3B is a bottom view of the tweeter assembly of FIG. 3.

FIG. 3B is a bottom view of tweeter unit 14 showing circular frame 14C, grill 14B, support sleeve 14E, tweeter 14A and electrical terminal 14D.

Figure 4:
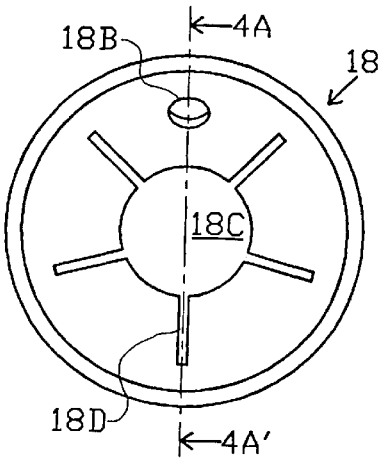
FIG. 4 is a front elevation of the shell housing shown in FIG. 1.

FIG. 4 is a front elevation of the shell housing 18 showing internally a cylindrical block 18C supported by an array of five surrounding gusset ribs 18D. Also shown is circular opening 18B for the hookup wire 16 (FIGS. 1, 2).

Figure 4A:
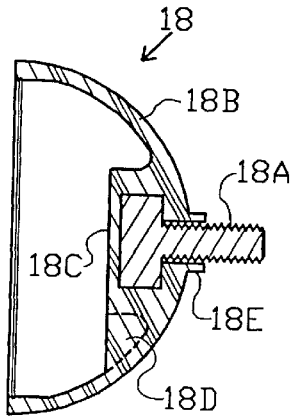
FIG. 4A is a central cross-section of the shell housing of FIG. 4

FIG. 4A is a cross-section of shell housing 18 taken at central axis 4A–4A' of FIG. 4, showing machine bolt 18A with its head molded integrally in block 18C of shell housing 18. One of the gusset ribs 18D and hookup wire opening 18B are seen in this cross-section as well as a rear guide-block 18E surrounding the shaft of bolt 18A.

Figure 4B:
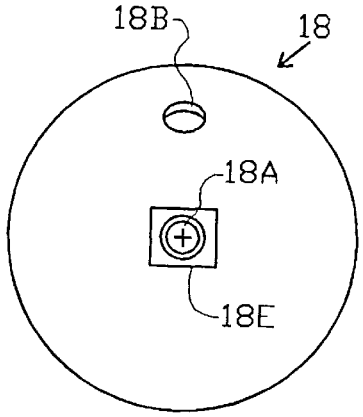
FIG. 4B is a rear view of the shell housing of FIG. 4.

FIG. 4B is a rear view of shell housing 18, showing hookup wire opening 18B and an end view of bolt 18A. Guide-block 18E surrounding bolt 18 is seen to have a rectangular shape.

Figure 5:
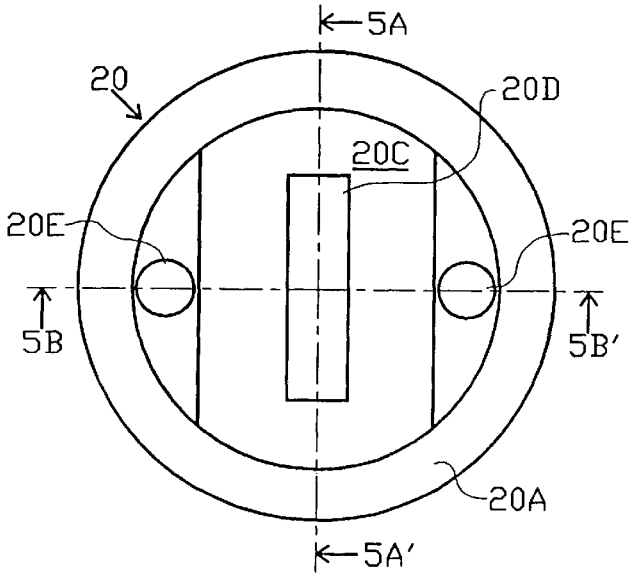
FIG. 5 is a front elevation of the mounting bushing shown in FIG. 1.

FIG. 5 is a front elevation of mounting bushing 20 (FIGS. 1, 2), showing the peripheral flange 20A and the cavity region bearing surface 20C configured with swivel guide slot 20D. A pair of rear subpanels of bushing 20 are each configured with a hookup wire opening 20E: either of these two openings 20E can be utilized to accommodate hookup wire (16). The space around each opening 20E is available to accommodate a slack portion of hookup wire (16) to facilitate swivelling of the tweeter/shell assembly.

Figure 5A:
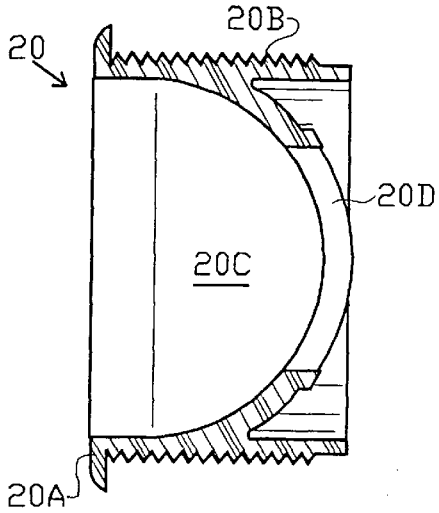
FIG. 5A is a central cross-sectional side view of the mounting bushing of FIG. 5.

FIG. 5A is a cross-sectional side view through central axis 5A–5A' of FIG. 5, showing swivel guide slot 20D configured in the hemispherical bearing surface 20C in the cavity region.

Figure 5B:
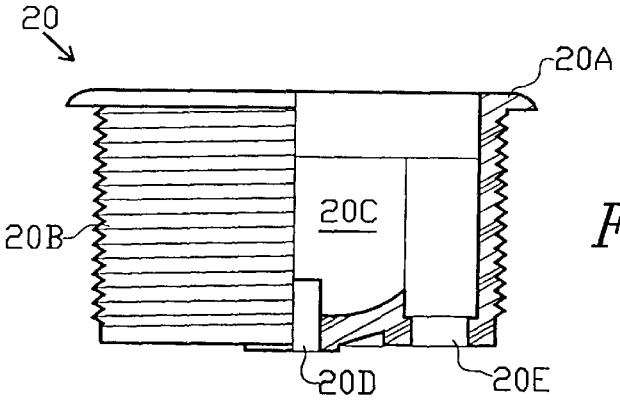
FIG. 5B is bottom view of the mounting bushing of FIG. 5 showing one half in central cross-section.

FIG. 5B is a partially-cutaway bottom view of the mounting bushing 20 (FIG. 5) showing, at the left side, the threaded exterior of sleeve 20B, and at the right side, a cross-section through central axis 5B–5B' (FIG. 5) showing a portion of hemispherical bearing surface 20C in the cavity region configured with swivel guide slot 20D and showing hookup wire opening 20E in a rear subpanel.

Figure 5C:
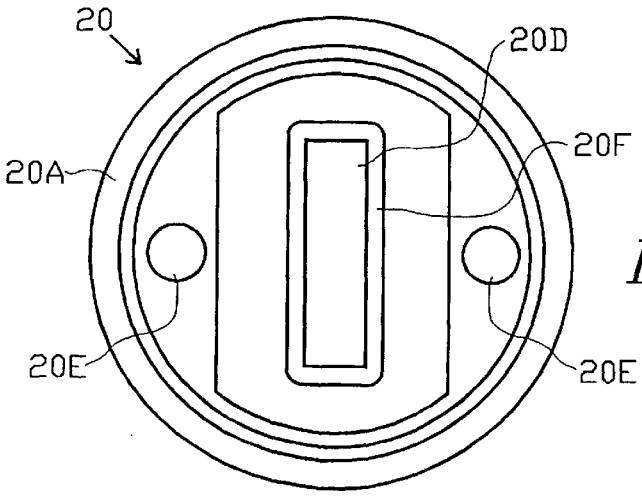
FIG. 5C is a rear view of the mounting bushing Δf FIG. 5.

FIG. 5C, the rear view of mounting bushing 20, shows the two hookup wire openings 20E in the two opposite rear subpanels, and shows the rear exit of swivel guide slot 20D configured to provide a surrounding bearing surface 20F for interfacing with spring washer 26 as it is held under compression by swivel-clamp nut 24 (FIG. 1). Slot 20D is dimensioned in width to provide a sliding fit with guide-block 18E at the rear of shell housing 18 (FIGS. 4A, 4B).

Figure 6:
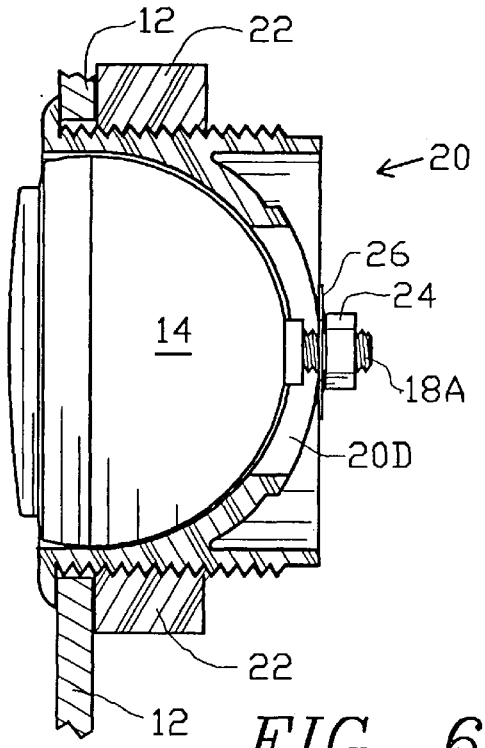
FIG. 6 shows a completed swivel tweeter assembly with the mounting bushing shown in cross-section mounted to the panel, showing a side view of the tweeter/shell assembly in place shown with the tweeter aimed on-axis.

FIG. 6 is a side view of a complete tweeter assembly of FIG. 2 showing the mounting bushing 20 in cross-section mounted to panel 12 and secured in place by mounting nut 22. An installed tweeter/shell assembly 14 is shown in side view, secured in place by swivel-clamp nut 24 and spring washer 26 on bolt shaft 18A, which passes through the swivel slot 20D. The tweeter is shown aimed on-axis: with this neutral swivel setting, the acoustic directivity is perpendicular to panel 12 and would be practically unaffected by any rotation of mounting bushing 20 in the opening in panel 12.

Figure 6A:
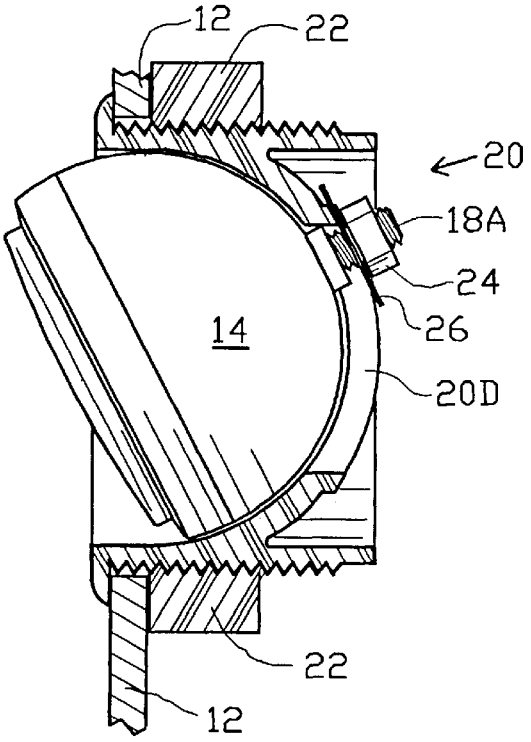
FIG. 6A shows the assembly of FIG. 6 with the tweeter aimed off-axis to the limit at one end of the swivel range.

FIG. 6A shows the subject matter of FIG. 6 with the tweeter/shell assembly 14 aimed approximately 27 degrees off-axis at the limit of the range provided by swivel slot 20D.

Figure 6B:
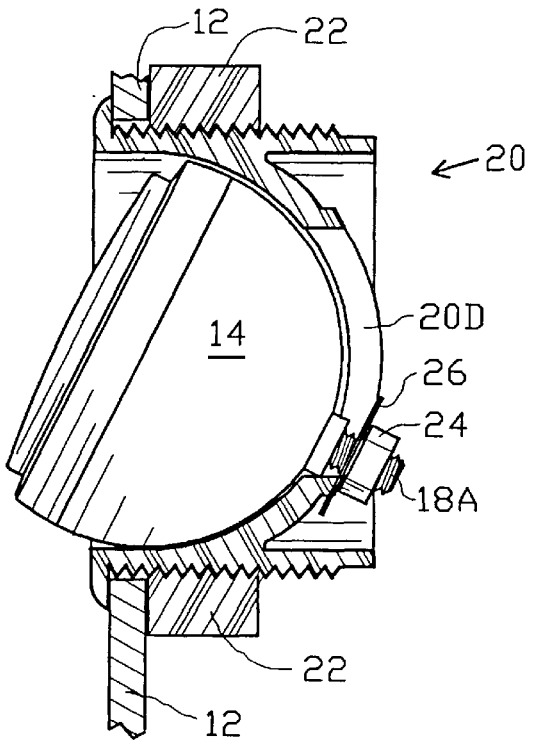
FIG. 6B shows the assembly of FIG. 6 with the tweeter aimed off-axis to the limit at the opposite end of the swivel range.

FIG. 6B shows the subject matter of FIG. 6 with the tweeter/shell assembly 14 aimed at the opposite end limit of the range provided by swivel slot 20D.

Referring again to FIGS. 1 and 2, for assembly the tweeter unit 14 is first assembled into shell housing 18, feeding the hookup wire through opening 18B (FIGS. 1, 4). Circular frame 14C snaps in place onto shell housing 18 in a detented manner, thus forming a tweeter/shell assembly 14 which is then installed into the mounting bushing 22, with the hookup wire fed through opening 20E (FIGS. 1, 5). Bolt 18A, with its shaft protruding through to the rear of the mounting bushing 20, is fitted with washer 26 and nut 24, which is tightened to clamp the tweeter/shell assembly 14 in place at a selected position in the swivel range. The mounting bushing assembly thus formed is then set into place in the panel through the panel opening and oriented as desired; then it is secured in place by threading main mounting nut 22 onto the rear of threaded sleeve 20B and tightening nut 22 against the rear of panel 12.

The tweeter/shell assembly may be re-aimed in any desired direction within its circular range by loosening swivel-clamp nut 24 and main mounting nut 22, aiming the tweeter/shell assembly as desired by swivelling it via bolt 18A to select the off-axis angle while simultaneously rotating the mounting bushing 20 in the panel opening 12A to select the desired angular position in the panel, then finally retightening swivel-clamp nut 24 and main mounting nut 22 to lock the assembly in place, aimed in the desired direction.

The major parts of the assembly may be molded from high impact styrene or other suitable plastic material; main mounting nut 22 may be molded in a hollow configuration to conserve material. Alternatively some or all parts could be molded or machined from metal such as aluminum. The grill treatment at the front can be varied since its role is non-critical in the practice of the invention.

The swivel mechanism shown provides a symmetrical travel range offset in both opposite directions from the central axis: this provides a minor convenience of aiming adjustment in that it may reduce the amount of rotational adjustment required since it limits the required range of panel-mount rotational adjustment range to 180 degrees. Optionally the swivel travel range could be limited to offset in only one direction from the central axis; this would require a full 360 degree range of rotational adjustment.

Due to the symmetrical internal configuration of the mounting bushing 20, it is convenient to provide two hookup wire openings 20E, even though only a selected one of these will be utilized; alternatively one of these openings 20E could be omitted, and the mounting bushing 20 could be configured internally in a non-symmetrical manner in this and other regards.

As an alternative to the slotted shape of the swivel guide slot 20D (FIGS. 1, 5 and 5C) this opening could be made larger and/or circular, and a large cup washer utilized at the rear, thus enabling a two-dimensional swivel adjustment range without loosening the main mounting nut 22.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A swivel tweeter assembly that flush-mounts to a panel of a host vehicle through a circular opening in the panel, comprising:

a hemispherically-shaped shell housing having a forward-facing main circular opening perpendicular to a central axis of the shell housing;

a tweeter unit, constituting a high frequency electro-acoustic transducer, mounted co-axially within said shell housing in a forward-facing position, thus forming a tweeter-shell assembly;

a mounting bushing configured externally as cylindrical sleeve having an annular flange extending radially at a forward end thereof and having internally a rear bulkhead articulated to define a cavity region, facing the forward end, having a bearing surface shaped as a portion of sphere arranged to interface with said hemispheric shell housing in a ball-joint manner that enables the tweeter-shell assembly to swivel off-axis relative to said mounting bushing within a predetermined swivel range;

shell fastening means for securing said shell housing to said mounting bushing at a selected off-axis angle within the swivel range; and bushing fastening means for securing said mounting bushing to the panel, with said mounting bushing placed in the round opening in a working disposition such that a rear surface of the flange interfaces a front surface of the panel, the mounting bushing being rotated to a selected angular disposition relative to the panel.

2. The swivel tweeter assembly as defined in claim 1 wherein said tweeter unit further comprises;

an acoustically transparent protective front grill; and a circular frame portion, surrounding said grill, constructed and arranged to attach to said hemispherically-shaped shell housing at a peripheral front region thereof, said circular frame portion being shaped to provide an annular outer peripheral surface shaped as a portion of a sphere defining an extension of the hemispheric shape of said shell housing, so as to facilitate swivelling thereof within said mounting bushing.

3. The swivel tweeter assembly as defined in claim 1 wherein the sleeve of said mounting bushing is externally threaded and wherein said bushing fastening means comprises a mounting nut threaded onto said externally threaded sleeve so as to bear against a rear surface of the panel thus holding the mounting bushing in the working disposition.

4. The swivel tweeter assembly as defined in claim 1 wherein said shell fastening means comprises:

a threaded shaft affixed to said shell housing in a coaxial relation thereto and extending rearwardly therefrom and extending through a slot provided in the bulkhead of said mounting bushing in a central region of the bearing surface;

a machine nut engaging said threaded shaft and tightened against a rear bearing surface of the bulkhead of said mounting bushing flanking the slot so as to secure said shell housing to said mounting bushing.

5. The swivel tweeter assembly as defined in claim 4 wherein said threaded shaft constitutes a shaft portion of a metal machine bolt integrally molded in plastic material of said shell housing.

6. The swivel tweeter assembly as defined in claim 5 further comprising a rectangular guide-block integrally formed at a rear region of said shell housing and centered around said threaded shaft, configured and arranged to fit slidingly in the slot provided in the bulkhead of said mounting bushing in a central region of the bearing surface so as to provide guidance for swivel movement.

7. A swivel tweeter assembly that flush-mounts to a panel of a host vehicle through a circular opening in the panel, comprising:

a hemispherically-shaped shell housing having a forward-facing main circular opening perpendicular to a central axis of the shell housing;

a tweeter unit, constituting a high frequency electro-acoustic transducer, mounted co-axially within said shell housing in a forward-facing position, thus forming a tweeter-shell assembly;

an acoustically-transparent protective grill in said tweeter unit, affixed in a frontal location thereof;

a mounting bushing configured to have externally as a cylindrical sleeve having an annular flange extending radially at a forward end thereof and configured internally with rear bulkhead articulated to define a cavity region facing the forward end with a bearing surface shaped as a portion of sphere arranged to interface with said hemispheric shell housing in a ball-joint manner that enables the tweeter-shell assembly to swivel off-axis relative to said mounting bushing;

fastening means, for securing said shell housing to said mounting bushing at a selected disposition within the swivel range, comprising (1) a threaded shaft of a machine bolt having a head integrally molded in said shell housing in a coaxial relation thereto such that said shaft extends rearwardly from said shell housing through a slot provided in the bulkhead of said mounting bushing in a central region of the bearing surface and (2) a machine nut engaging said threaded shaft and tightened against a rear bearing surface of the bulkhead of said mounting bushing flanking the slot, so as to secure said shell housing to said mounting bushing; and a mounting nut threaded onto the externally-threaded sleeve of said mounting bushing and tightened against a rear surface of the panel so as to thus hold the mounting bushing in place in the panel in a working disposition.

8. The swivel tweeter assembly as defined in claim 7, further comprising a circular frame portion of said tweeter, surrounding said grill, constructed and arranged to attach detentedly to the forward-facing main circular opening of said hemispherically-shaped shell housing, said circular frame portion being shaped to provide an outer peripheral surface shaped as a portion of a sphere defining an extension of the hemispheric shape of said shell housing, so as to facilitate swivelling thereof within said mounting bushing.

9. The swivel tweeter assembly as defined in claim 8 further comprising a spring fender washer deployed on said threaded shaft between said machine nut and the rear bearing surface of the bulkhead.

* * * * *